US005195583A

United States Patent [19]

Toon et al.

[11] Patent Number: 5,195,583

[45] Date of Patent: Mar. 23, 1993

[54] BOREHOLE PACKER

[75] Inventors: Donald A. Toon, Burlington; Douglas J. Belshaw, Georgetown, both of Canada

[73] Assignee: Solinst Canada Ltd, Glen Williams, Canada

[21] Appl. No.: 765,246

[22] Filed: Sep. 25, 1991

[30] Foreign Application Priority Data

Sep. 27, 1990 [GB] United Kingdom ..... 9021059

[51] Int. Cl.[5] ..... E21B 33/127

[52] U.S. Cl. ..... 166/187; 29/454; 29/888.3; 166/179

[58] Field of Search ..... 166/187, 179, 192; 29/888.3, 454, 530

[56] References Cited

U.S. PATENT DOCUMENTS 2,945,541 7/1960 Maly et al. ..... 166/187 X
3,301,329 1/1967 Martin ..... 166/187
4,137,970 2/1979 Laflin et al. ..... 166/179 X
4,674,570 6/1987 Jackson ..... 166/187
5,048,605 9/1991 Toon et al. ..... 166/187

FOREIGN PATENT DOCUMENTS 1460198 2/1989 U.S.S.R. ..... 166/179

*Primary Examiner*—Hoang C. Dang

[57] ABSTRACT

The packer (4) is for use in isolating long lengths (i.e. heights) of a borehole (2), e.g. between sampling points. The packer includes bentonite (23) which is activated by the natural groundwater in the borehole. The water is admitted into the bentonite through narrow portholes (21), which delays the flow of water into the packer. The water is distributed evenly throughout the bentonite by blotting paper (14,16) which soaks up the incoming water and prevents the water passing to the bentonite until the blotting paper is all saturated. Alternatives to the use of blotting paper, to transmit the water evenly over and through the whole body of bentonite, include perforated corrugated plastic, corrugated cardboard, and perforated plastic pipes.

13 Claims, 3 Drawing Sheets

BOREHOLE PACKER

This invention relates to borehole packers. Packers are used in boreholes for such activities as isolating instruments that measure aquifer conditions.

Use of the packers enables groundwater to be confined to particular levels in the borehole and enables the groundwater to be constrained against moving vertically up or down the borehole.

Borehole packers have hitherto been seen as expensive items. As a result, the designer of a borehole system has specified packers only at well-spaced locations along the depth of the borehole. In the known systems, the packers actually occupy only a tiny proportion of the total depth of the borehole, the packers being so arranged, along the length or depth of the bore-hole, as to achieve the maximum strategic sampling effect; and one of the skills required of the borehole designer has been in achieving good isolation of the sampling zones while using a minimum number and size of packers.

As an alternative to a pre-manufactured expandable packer, it is known for a designer to specify that water-expandable material to poured into the borehole, after the instrumentation has been put in place, to seal up the "dead" empty spaces in the borehole. This can be done progressively as instrumentation is built up in the borehole. However, the process of pouring in loose dry particles, or powder, or granules, of bentonite or other expandable material has rarely proved satisfactory: the particles catch on the walls etc and absorb wetness or moisture, and tend to swell prematurely, and in the wrong places.

Thus, while the expense of pre-manufactured packers can be tolerated for the purpose of isolating the actual sampling zones, the need is clear for an inexpensive packer that will prevent vertical movement of water in the dead portion of the borehole that lies between the sampling zones. If this inexpensive packer can be designed to be so secure that the inexpensive packer can itself be used to isolate the sampling zones, then so much the better; but the real need is that the inexpensive packer will prevent gross flow up and down the dead portions of the borehole, in the areas between the sampling zones. Minor leakage or seepage in the dead portion is not so important.

The invention is aimed at providing a pre-manufactured packer that is so inexpensive to manufacture and use that the engineer will consider it economical to fit the packers over the whole depth of the borehole. This is likely to lead to a greater accuracy of sampling results, because a fully packed borehole is more nearly representative of the ground as it was before it was disturbed than is a borehole which permits a substantial up/down circulation or transference of groundwater.

The pressure of the groundwater in a borehole is hard to predict and to measure. In fact, a borehole might be dry when packers are installed, but might later contain water, and the natural borehole water pressure might vary naturally with rises and falls in the local water table. It has been known for the same borehole on one occasion to be dry and on another occasion to contain artesian pressure.

To ensure a good seal in a packer of the surface-activated kind, the pressure of the water fed from the surface must be high enough to cater for these variations. Sometimes, therefore, it may happen that the pressure within a surface-activated packer is very much higher than the pressure of the groundwater surrounding the packer, with the result that the packer would tend to balloon out into such fissures etc as may be present, if precautions were not taken. A surface-activated packer must therefore incorporate some means for preventing ballooning, and such means are invariably expensive.

An example of a surface-activated packer with an anti-ballooning means is shown in WO-88/03597 (BELSHAW, May 88).

The tendency has therefore been, hitherto, for the engineer to specify the expensive surface-activated packers immediately above and below the sampling zone, to provide the required good seal, but to leave clear the dead area between the sampling zones. This has meant that groundwater could pass freely up and down the dead area of the borehole, with the result that water from a considerable distance might easily be present very close to a sampling zone. The engineer cannot rely upon such water not to seep through the surrounding aquifer material into the sampling zone. But it has been too expensive for the engineer to provide surface-activated packers, with their expensive anti-ballooning systems, throughout the whole sampling range of the borehole.

GENERAL FEATURES OF THE INVENTION

If the packer can be activated by the groundwater that is naturally present in the borehole, or at least by water whose pressure is no greater than that of the groundwater, the problem of the packer ballooning out into fissures becomes no longer a problem. A difficulty with a ground water-activated packer lies in how the expandable material is to be introduced into its correct location in the borehole, and manipulated into position, without expanding prematurely; once the groundwater touches the packer material, the packer material starts to expand. Another difficulty lies in how the expandable material, in dry form, is to be contained within the packer.

Yet another difficulty lies in the fact that expandable packer material, such as bentonite, tends to become impermeable when wet. Therefore, the designer should ensure that the groundwater is not called upon to penetrate through already wetted bentonite in order to reach the remaining dry bentonite. There would be little point in a packer that expanded fully at the point where water was admitted, if the rest of the packer were to remain unexpanded.

A further difficulty arises from the shape of the packer. Inevitably, the packer is relatively long and slender. Its structure includes an inner tube which contains the conduits etc for the down-hole instrumentation. Whilst the inner tube of course is smaller than the borehole, nevertheless the annular space available between the inner tube and the borehole, i.e. the space into which the bentonite or other packer material is to fit, is very limited. The bentonite therefore comprises only a thin annular layer, and the manner of locating the bentonite within the packer must be such that the thin annular layer of dry bentonite granules remains intact and in position until the packer is installed in its final location in the borehole.

A quantity Q of water is the quantity of groundwater from the borehole that is required to be admitted into the body of expandable material in the packer, in order to fully expand the body of expandable material. In the invention, the packer includes a port or ports for admitting the quantity Q. The invention provides also a distribution means, for distributing the received water Q throughout substantially the whole body of expandable material. The invention provides also a delay means, for delaying the said distribution of water.

The transmission means may comprise, for example, a sheet of water-absorbent material, which is wrapped around the inner tube of the packer. The absorbent material should be of the kind which remains permeable even when wet. An example of a suitable water-absorbent material which remains permeable is blotting paper.

Water enters through the ports, and is absorbed into the absorbent material. The nature of the absorbent material should be such that the water prefers to travel through the absorbent material, by progressive absorption, rather than to pass from the absorbent material into the expandable material. In other words, the absorbent material should preferably be such that the excess water does not start to pass from the absorbent material into the expandable material, until after the whole body of absorbent material has become thoroughly saturated. The absorbent material preferably occupies the full length (i.e. the full vertical height) of the packer, with the result that water is transmitted and distributed and is present throughout the full length of height of the packer before the water starts to enter the expandable material.

This is not to say that the whole body of bentonite remains completely dry until the whole body of absorbent material becomes saturated, but rather that the bentonite near to the port does not immediately soak up all the water entering through the port, and that some of the water is allowed to pass through the absorbent material to the rest of the body of bentonite.

In place of the absorbent material just described, the transmission means may comprise other suitable mechanisms. For example, the transmission means may comprise a sheet of woven geotextile material. The points noted above, regarding the fact that the material should continue to transmit water even though the bentonite is becoming impermeable, apply, whatever the material.

The transmission means may comprise means other than a fabric material: for example, a series of transmission pipes, with facility to distribute the water, may also be used. The various alternatives are described in more detail below.

The delay means may comprise a restriction in the cross-sectional area of the port or ports. A typical packer might contain 3 liters of expandable packer material, and by the time the packer has expanded sufficiently to fill the borehole, will contain a quantity Q of water of, typically, 10 liters or so. If ports are provided one at each end of the packer, and if both ports are restricted to about 2 sq mm cross-sectional area, then it will take several hours, or even a day or two, for the quantity Q to be admitted into the packer, and for the packer to fully expand. The actual rate depends on a number of factors, including the pressure, temperature, salinity, etc, of the groundwater in the borehole.

Other delay means will be described below.

The ports should be so sized and arranged that the particles of bentonite cannot enter, or fall out through, the ports during manufacture, transport, and installation of the packer. It is preferable, for the purpose of taking evidence in a pollution case, for example, if the engineer in charge of the sampling operation can declare that the bentonite itself cannot possibly have been the source of any contaminants that might be present in the borehole. The small-area ports, as described, will generally be accepted by a tribunal as providing effective isolation for the bentonite.

The packer of the invention uses groundwater from the borehole itself as the water which expands the packer. In contrast to the type of packer which is activated by water fed down from the surface, the packer of the invention is not prone to ballooning out into fissures, etc., in the borehole wall.

The packer of the invention is economical to provide in long lengths, with the result that the whole depth of a borehole may be packed properly and effectively. The invention can therefore help in creating down-hole conditions which are as close as possible to the conditions which obtain before the ground was disturbed.

Hitherto, as mentioned, bentonite has simply been poured straight into the hole in an attempt to pack the hole. In that case, not the least of the problems the engineer faces is that he cannot tell for sure whether the hole is packed or not. With the packer of the invention, the engineer at least can be sure that the packer is present in the hole, and at what depth.

As will be described later, the invention also addresses the problem of how the dry granular expandable material is to be assembled into, and confined within, the structure of the packer.

One of the preferred uses of the packer of the invention is in combination with packers of the surface-activated type. Packers which are activated by pressure from the surface can be made to seal very tightly to the walls of the borehole, and this of course is a useful attribute, particularly in isolating a small zone of the borehole from which an actual sample is to be taken. Thus, a pair of surface-activated packers may be provided in respect of each sampling zone, one above and one below the sampling zone, whilst the relatively long "dead" height of the borehole between the sampling zones is occupied by the packer of the invention.

The packer of the invention may be manufactured in standard lengths, such as 1.5 or 2 meters, which are easy to handle. Several packers could be fitted in series for deep boreholes.

DETAILED DESCRIPTION OF PREFERRED EMBODIMENT

By way of further explanation of the invention, an exemplary embodiment of the invention will now be described with reference to the accompanying drawings, in which.

The apparatus shown in the accompanying drawings and described below are examples which embody the invention. It should be noted that the scope of the invention is defined by the accompanying claims, and not necessarily by specific features of exemplary embodiments.

Figure 1:
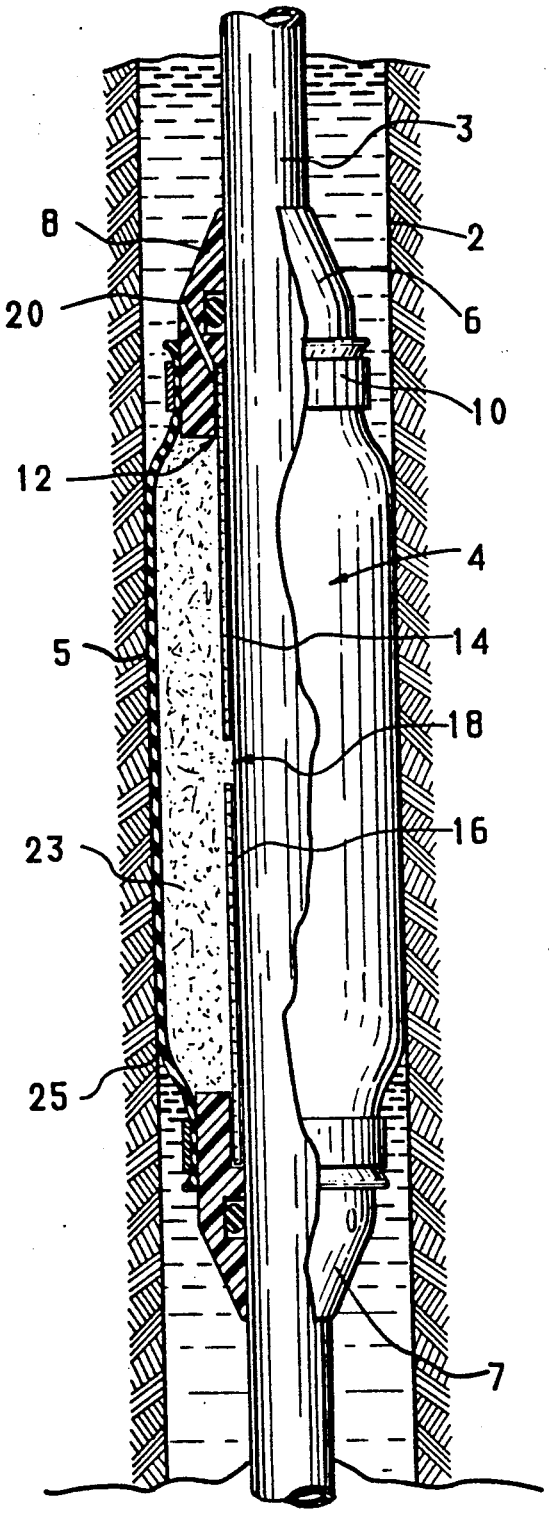
FIG. 1 is a cross-section of a packer which incorporates the invention, shown installed in a borehole.
Figure 2:
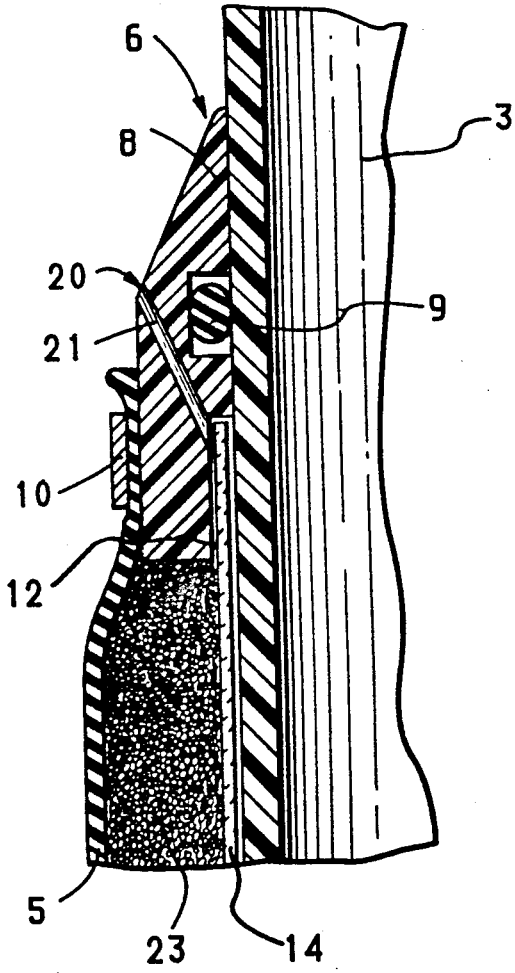
FIG. 2 is a cross-section showing a close-up of some of the components of the packer of FIG. 1.

As shown in FIG. 1, a borehole 2, prepared by drilling, is suitable for the taking of measurements relating to below-ground parameters. A central tube 3, made of thick, rigid, plastic, extends down from the surface, and the various services (not shown) for the measuring instruments are housed within the tube 3.

A packer 4 provides a seal between the tube 3 and the borehole 2.

In the installation shown in FIG. 1, the function of the packer 4 is to prevent the flow of groundwater vertically up and down the borehole, and thus to isolate the zones where measurements are actually being taken. The zones themselves are not shown in FIG. 1.

The packer 4 utilises the tube 3 as a rigid inner tube of the packer. An outer tube or sleeve 5 is of thin rubber. The rubber is plain gum rubber, which contains no reinforcements, and is very flexible and stretchable.

Upper and lower end-pieces 6,7 are included at the ends of the packer 4. Each end-piece comprises a plastic moulding 8. The moulding 8 is provided internally with an O-ring 9, which seals the end-piece onto the inner tube 3. The moulding 8 is suitable, as to its outer diameter, to receive the outer tube 5, and a tube-clamp 10.

The moulding 8 also includes a recess 12. Positioned in the recess, and extending into the packer along the length of the inner tube 3, is a sheet 14 of water-absorbent material: in this case, blotting paper. The sheet of blotting paper encircles the inner tube 3, and the sheet 14 extends almost to halfway along the length of the packer. A corresponding sheet 16 extends from the other end-piece 7. The sheets 14,16 do not meet or overlap, and in fact a gap 18 is left between the sheets.

The moulding 8 also includes a port 20, in the form of a through-hole which communicates the recess 12 with the outside, and thus with any water which may be present in the borehole outside the packer.

A body 23 of expandable packer material occupies the annular space 25 between the inner and outer tubes. The expandable material in this case is bentonite, which expands and swells considerably when wet. The bentonite is inserted, dry, into the packer in granular or powder form.

When the packer is inserted into the borehole, the diameter of the outer tube 5 is considerably less than the diameter of the borehole, and so that packer passes easily down the borehole. During insertion of the packer, any water present in the hole can easily pass up and down the hole, outside the outer tube.

Once the packer is below the level of water in the borehole, water starts to enter through the ports 20. The hole 21 is of such a small diameter that water enters only very slowly. The water contacts the blotting paper 14,16 and gradually soaks the whole sheet of blotting paper. Blotting paper is a very absorbent material, so that water tends to permeate throughout the blotting paper rather than flow out of the blotting paper into the bentonite.

Eventually, however, as more water enters through the ports 20, the blotting paper becomes saturated, and the water starts to soak into the bentonite. Blotting paper has a tendency to soak up the water into itself, and not allow the water to enter the bentonite until the whole of the sheet of blotting paper has become saturated; this tendency is useful, in the invention, insofar as it ensures that the whole of the body of bentonite at first remains dry, or substantially dry, and then, once wetting starts, the whole of the body of bentonite becomes wetted together. Thus, the blotting paper acts to wet all the bentonite simultaneously, smoothly, and evenly.

As the bentonite 23 becomes wet, it swells, and continues to swell until the outer tube 5 has expanded sufficiently to fill the borehole 2. The pressure which the expanding bentonite exerts is sufficient to stretch the rubber of the outer tube 5, and to force the tube to conform to any minor irregularities in the surface of the borehole. However, the excess of pressure created within a body of bentonite upon becoming wet is only a little greater than the pressure of the water. Therefore, the outer tube 5, while it will expand to fill the borehole 2, does not tend to balloon outwards into fissures etc that may be present.

Whatever the pressure of the groundwater (within limits) the packer will press against the sides of the borehole with a slightly greater pressure.

When bentonite becomes wet, it unfortunately tends also to become impermeable, in that water can penetrate only a small distance into wet bentonite even if there is dry bentonite beyond the wet. It will be noted that the blotting paper comprises a transmission means, through which water can be transmitted evenly throughout the body of bentonite, without the water having to be transmitted through the bentonite itself. The annular space 25 is typically about 10 mm wide, radially, so that the water is called upon to penetrate only this small distance through bentonite.

Without the blotting paper to act as a transmission means, the bentonite adjacent to the ports 20 would swell, and would then become impermeable, so that the rest of the body of bentonite would remain dry, and would not expand.

As a matter of design, the hole 21 should not be large, and the blotting paper should not be too quick to soak up water. The intention is that it should take several hours, or even a day or two, after the packer 4 is lowered into the water before the packer becomes fully sealed into the borehole. This period permits the packer 4 to be manipulated into its correct position, and permits other expandable packers, which might be activated from the surface, to be also set in place before the packer 4 become immovable.

The packer 4 as described is activated by the groundwater inside the borehole 2, outside the packer. As mentioned, the pressure exerted by the outer tube 5 against the sides of the borehole is not much greater than the pressure of the groundwater. In many installations, therefore, the packer 4 cannot be relied upon to be a complete seal in the borehole: rather, the presence of the packer 4 should, in those cases, be regarded merely as preventing a gross flow of water up and down the borehole, as distinct from effecting a reliable and perfect seal.

Figure 3:
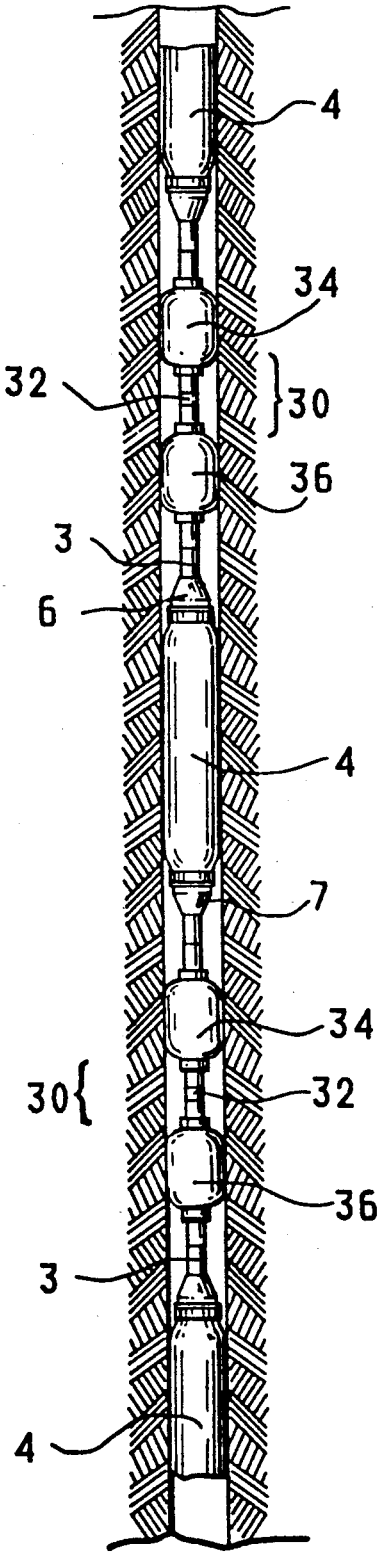
FIG. 3 is a view of a borehole, showing a number of packers installed in series.

FIG. 3 shows an installation which includes a groundwater sampling zone 30, from which water is drawn off for test purposes through a sampling port 32. Packers 34,36 isolate the sampling zone 30 from the rest of the borehole. The packers 34,36 are of the kind that are activated (i.e. expanded) by means of a water pressure fed down the inner tube 3 from the surface. With this kind of packer, the engineer generally must ensure that the actuation pressure of the water from the surface is usually considerably greater than the pressure of the down-hole groundwater, in order to ensure that the packer presses very tightly against the sides of the borehole.

To ensure a good seal in a packer of the surface-activated kind, the pressure of the water fed from the surface must be high enough to cater for these variations. Sometimes, therefore, it may happen that the pressure within a surface-activated packer is very much higher than the pressure of the groundwater surrounding it, with the result that the packer would tend to balloon out into such fissures etc as may be present, if precautions were not taken. A surface-activated packer must therefore incorporate some means for preventing ballooning, and such means are invariably expensive.

The tendency has therefore been, hitherto, for the engineer to specify the expensive surface-activated packers immediately above and below the sampling zone, to provide the required good seal, but to leave clear the area between the sampling zones. This has meant that groundwater can pass freely up and down the borehole, with the result that water from a considerable distance can easily be present very close to a sampling zone, and the engineer cannot rely upon such water not to seep through the surrounding aquifer material into the sampling zone. But it has been too expensive for the engineer to provide surface-activated packers, with their expensive anti-ballooning systems, throughout the whole sampling range of the borehole.

Figure 4:
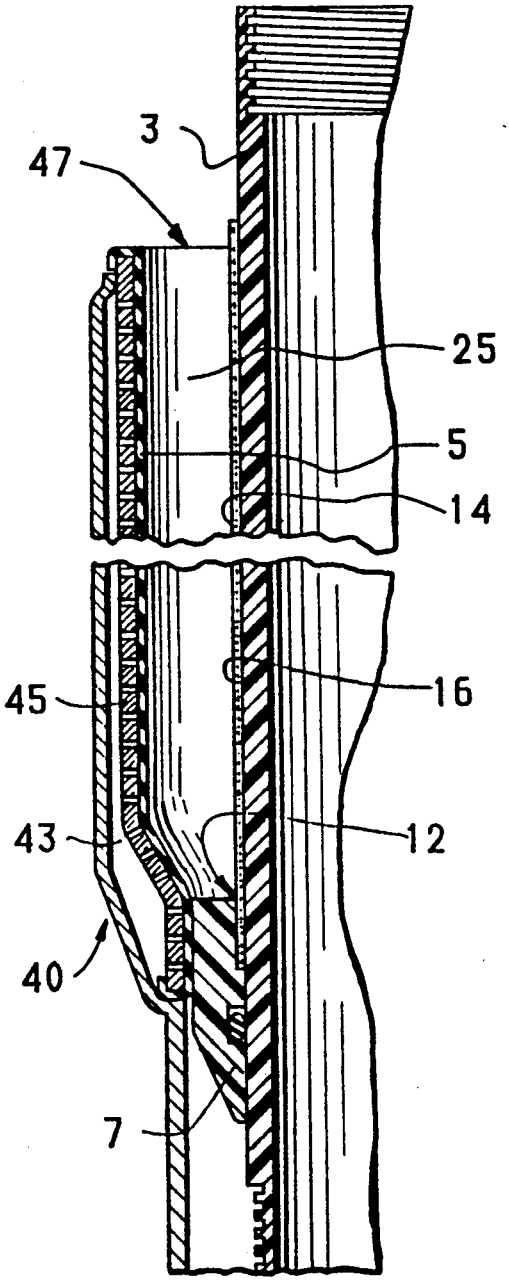
FIG. 4 is a cross-section of the packer of FIG. 1, shown at a stage in the manufacture of the packer.

FIG. 4 illustrates the manner in which the packer of FIG. 1 may be assembled. The rubber outer tube 5 is placed within a vacuum unit 40. The upper and lower ends of the tube 5 are stretched over, and sealed to, suitable spigots in the vacuum unit. When the space 43 in the vacuum unit is evacuated, the tube 5 is sucked outwards, and expands into conformity with the wall 45.

The upper and lower sheets 14,16 of blotting paper are wrapped around the inner tube 3, and lightly held in place with, for example, adhesive tape. The lower end-piece 7 is slipped over the lower end of the tube 3, where it is held in place by the friction of the O-ring 9. During assembly, the technician takes care that the blotting paper enters the recess 12 in the moulding 8 of the lower end-piece 7. The sub-assembly comprising the tube 3, the lower end-piece 7, and both sheets 14,16 of blotting paper, is placed inside the stretched-out rubber tube 5, the condition as shown in FIG. 4.

The top of the space 25 constitutes an annular open mouth 47. Expandable packer material, in (dry) powder or granular form, is poured into this mouth. Sufficient material is poured in to fill up the annular space 25.

When the space 25 is full, the upper end-piece 6 is slipped over the inner tube 3, again taking care that the blotting paper 14 properly enters the recess 12. The vacuum can then be released, which causes the rubber tube 5 to shrink onto the bentonite grains, thus containing and supporting the grains. Finally, the top end of the outer tube 5 is clipped or clamped around the upper end piece 6. The dimensions of the components are such that the tube 5, when the vacuum is released, grips the grains of bentonite so tightly that the grains will not move, even though the packer may be subject to the usual knocks and other abuse during transport and installation. The correct degree of tightness of the rubber outer tube 5 is generally achieved only when the nominal, unstretched, diameter of the rubber tube 5 is less than the diameter of the inner tube 3.

Figure 5:
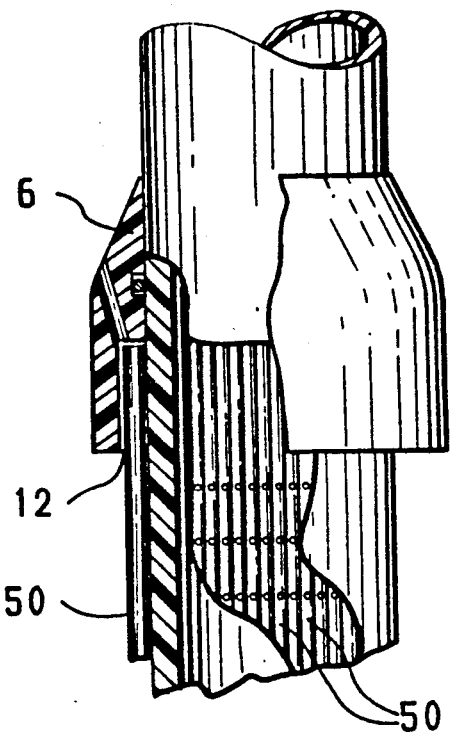
FIG. 5 is a view corresponding to FIG. 2, of another packer.

FIG. 5 shows a modification to the packer just described. In FIG. 5, the blotting paper is replaced by a series of small plastic pipes 50. The pipes 50 have an internal bore of 2 mm or so, and the walls of the pipes are perforated every 2 cm or so. Water enters the pipes 50 via the ports 20, as with the blotting paper, and passes along the pipes and thence into contact with the bentonite 23. The pipes 50 lie along the inner tube 3 and extend right around the circumference of the inner tube.

The pipes 50 are preferred over blotting paper for the longer lengths of packer, i.e. for packers of 2 meters axial length or more, as providing a more positive, even, transmission of the water over long distances. On the other hand, the pipes are more expensive and tricky to assemble. Pipes also occupy more radius: the pipes take up space that could otherwise be occupied with more bentonite.

As a further alternative, the pipes 50 may be replaced by corrugated plastic sheet, suitably perforated. As yet another alternative, corrugated cardboard may be substituted although the water-transmission passages in corrugated cardboard can sometimes be closed off by the swelling bentonite.

Good results have also been obtained by making the sheets 14,16, not from blotting paper, but from geo-textile material. Geo-textile material is a generic term for many types of woven polypropylene, etc., fabric. The fabric sold under the Tradename MIRAFI, of 1.5 mm thickness, is one that has been found suitable for use in the invention.

The geotextile fabric is wrapped around the inner tube 3 in the same manner as described in relation to the blotting paper. The fabric is effective at transmitting water evenly and thoroughly over the whole sheet of fabric. The water in fact travels along the spaces between the woven fibres: fibres of polypropylene themselves do not readily absorb and transmit water.

The interaction of the ports 20 and the water transmission means will now be described. The intention is that groundwater from the borehole enters only very slowly through the ports 20, but that once the water is through the port 20 the water can spread quickly and evenly throughout the transmission means, and into the body of expandable material. The intention is that the packer is slow to start to expand, being delayed preferably for several hours after the packer is lowered into the hole, but that eventually, when the packer does expand, it does so evenly and completely. It has been found that a good degree of delay is achieved when the hole 21 in the port 20 is 1.5 mm or so in diameter.

An advantage that arises when the ports 20 are of the form as described is that the operation of the ports is entirely passive, i.e. the engineer simply lowers the packer down the borehole, and the groundwater in the borehole automatically flow into the ports and activates the expandable material. As described, it has proved to be possible to delay the expansion of the packer material for a convenient period of time, and yet to ensure that the packer eventually does expand fully and evenly. The ports 20 are of course very inexpensive to provide, and no connection with the surface is required in order to activate the packer.

Figure 6:
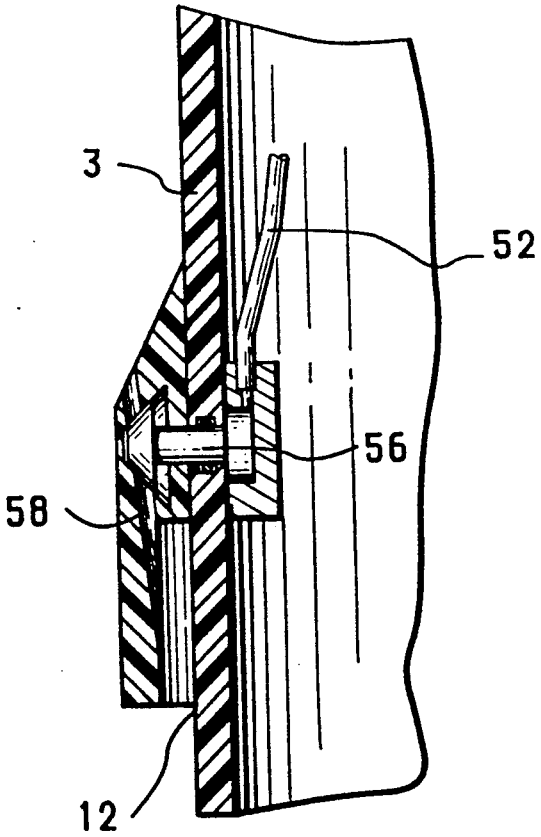
FIG. 6 is a view corresponding to FIG. 2, of yet another packer.

On the other hand, it is contemplated in the invention that the ports 20 might be of the kind that are operated from the surface. An example is shown in FIG. 6. Here, a line 52 extends up the inside of the inner tube 3 to the surface. The inner tube has a hole through its wall, with which the lower end of the line connects. A piston 56 is held outwards by (e.g. nitrogen) pressure in the line, in which condition the piston 56 blocks the hole 58 (corresponding to hole 21) connecting the recess 12 with the groundwater in the borehole. When the engineer wishes to activate the packer, he releases the pressure in the line 52, whereby the piston 56 moves clear of the passage 58.

Apart from the extra expense of providing the components shown in FIG. 6, the addition of an extra line inside the inner tube 3 imposes a space penalty. The inner tube is generally packed with pipes and conduits for servicing the various sampling ports, and there is little room for more. However, the packer can, in the right circumstances, be activated from the surface in the manner described.

It is also contemplated that the delay means could be comprised by a body of slow-to-dissolve material. This material would be inserted preferably into the port or ports. When the packer is lowered into the borehole, the groundwater contacts the dissolvable material, which then starts slowly to go into solution. When the material has all dissolved, water enters through the port and into the transmission means. One of the benefits of this arrangement is that the ports can be quite unrestricted so that the water, when it finally does enter, can flow in strongly.

The dissolvable material must be selected so as not to be itself suspected of contributing to any contamination which might be present in the borehole.

The gap 18, as previously referred to, is important for the following reason. A desired function of the packer is to isolate the sampling points in the borehole; and in fact to return each sampling point as much as possible to the condition it was in before the ground was disturbed. Without the gap 18 in the transmission means (blotting paper or other) there would be a passage, or at least a notional passage, vertically right through the whole height of the packer. Water could, at least theoretically, seep from the sampling point above the packer right through to the sampling point below the packer. The gap 18 ensures that there is no through-passage.

The gap 18 should be wide enough that water cannot cross the gap: on the other hand, the gap should not be so wide that some of the bentonite might remain dry. Bentonite becomes almost impermeable when wet, so that water substantially cannot penetrate very far through saturated, swelled, bentonite to the dry bentonite beyond.

As shown, the packer is fed with water symmetrically from both ends, and the gap 18 is in the centre of the height of the packer and is about 2 cm wide.

In the case of a very long packer, the central portion of the body of bentonite may be considered to be very remote from the ends. If so, an extra supply port may be incorporated at the upper or lower end of the packer, and a (large) transfer pipe may be provided to transfer groundwater from the port directly without resistance to the central portion. Only one gap 18 need be provided.

As described, the body 23 of bentonite preferably is in powder or granular form. Bentonite is easy enough to process into other shapes, such as balls, which also can be poured. It is also contemplated that the bentonite may be moulded into tubes, or half-tubes, which can be inserted rather than poured, into the mouth 47, although large mouldings in bentonite tend to be fragile. Other water-expandable packer materials are available, some of which, though more expensive, are easier to handle in moulded-tube form.

The invention should not be construed as being limited to a particular form of expandable material. The important aspect of the invention is the provision of the means for receiving groundwater from the borehole, not water from the surface, and for transmitting the received groundwater evenly over the whole body of expandable material, and in ensuring a delay so that the packer can be moved and adjusted and manipulated for at least several hours after insertion into the borehole.

We claim:

1. Borehole packer assembly, wherein:

the assembly includes an inner tube, and an outer tube of elastomeric material that is flexible and stretchable;

the inner and outer tubes are so dimensioned and arranged as to create an elongate annular chamber therebetween;

the annular chamber is elongate in the sense that the chamber is many times longer in its axial extent than in its radial extent;

the assembly includes means for closing off the upper and lower ends of the annular chamber;

the assembly includes a body of expandable packer material, the material being of the kind which expands considerably when wet, and which becomes impermeable when wet;

the body of expandable packer material is located in, and substantially fills, the elongate annular chamber;

the assembly includes an activation port or ports, so disposed as to provide passage between the said chamber and natural groundwater present in the borehole;

the nature and dimensions of the body of expandable packer material are such that a quantity Q of the groundwater is required to be introduced into the body of material in order for the body to expand sufficiently to fully seal off the borehole;

the assembly includes a distribution means, which is effective to distribute the quantity Q of the groundwater received via the port or ports throughout the whole body of expandable packer material;

and the assembly includes a delay means which is effective to delay for a substantial period of time, passage of the full quantity Q of the groundwater from the port or ports, through the distribution means and into the body of expandable packer material.

2. Assembly of claim 1, wherein the delay means comprises a restriction in the cross-sectional area of the port or ports, whereby the groundwater can pass only very slowly from the port or ports, through the distribution means, and into the body of packer material.

3. Assembly of claim 2, wherein the diameter of the port or ports is 1.5 mm.

4. Assembly of claim 1, wherein the distribution means comprises a body of permeable, absorbent material, the absorbent nature of which is such that groundwater supplied to one area of the body of absorbent material spreads throughout the whole of the body.

5. Assembly of claim 4, wherein the permeable, absorbent material is blotting paper.

6. Assembly of claim 4, wherein the body of absorbent material is so disposed within the annular chamber that substantially all of the expandable packer material is so closely adjacent to the absorbent material that substantially all of the packer material is wettable by water present in the absorbent material.

7. Assembly of claim 1, wherein the dimensions of the outer tube, and the quantity of the expandable packer material contained in the annular chamber, being the volume of the material when dry and unexpanded, are such that the elastomeric material is stretched tightly over the dry unexpanded packer material.

8. Packer of claim 7, wherein the packer is a packer that has been manufactured in accordance with the following procedure, in which:

the procedure includes the step of providing the outer tube of stretchable elastomeric material, and the inner tube of rigid material, the tubes being co-axial and vertical;

the procedure includes the step of expanding the diameter of the outer tube by stretching the elastomeric material, to a sufficient degree that the annular chamber is created between the inner and outer tubes;

the unstretched diameter of the outer tube is such that such an annular chamber does not, in substance, exist until the diameter of the outer tube is expanded by stretching;

the procedure includes the step of closing off the bottom axial end of the said annular chamber, and of arranging the top axial end of the annular chamber as an open mouth;

the procedure includes the step of admitting the expandable packer material into the said mouth, and thereby into the annular chamber;

the expandable packer material is in granular or particulate form; the procedure includes the step of admitting a sufficient quantity of the packer material to substantially fill the chamber;

the procedure includes the step of closing off the top end of the annular chamber;

the procedure includes the step of releasing the stretch or expansion of the outer tube, whereupon the outer tube contracts and thereby acts to compress the material contained within the annular chamber.

9. Assembly of claim 6, wherein the absorbent material is in sheet form, and is wrapped circumferentially around, and in contact with, the inner tube.

10. Assembly of claim 1, wherein the elastomeric material of the outer tube is substantially imperforate and impermeable.

11. Assembly of claim 10, wherein:

the outer tube comprises a cylindrical tube of elastomeric material, the tube itself being open at both ends;

the apparatus includes upper and lower annular end-pieces, made of comparatively rigid material, which sealingly encircle the inner tube at the top and at the foot respectively of the outer tube;

the open ends of the outer tube are sealingly clamped to the respective end pieces;

the activation port comprises a through-hole formed in the rigid material of one of the end-pieces;

and the delay means comprises a restriction in the cross-sectional area of the said port.

12. Assembly of claim 11, wherein:

the distribution means comprises a body of permeable, absorbent material, the absorbent nature of which is such that groundwater supplied to one area of the body of absorbent material spreads throughout the whole of the body;

and the absorbent material extends into contact with that end-piece in which the activation port is located, the contact being such that water entering the port can flow into and be absorbed into the absorbent material.

13. Assembly of claim 12, wherein the apparatus includes a gap means, for rendering the distribution means discontinuous and impervious to a through flow of water between the upper and lower end-pieces.

* * * * *